United States Patent [19]

Erickson

[11] Patent Number: 4,495,858

[45] Date of Patent: Jan. 29, 1985

[54] FIXED BLADE AIR BLENDER APPARATUS

[75] Inventor: Donald P. Erickson, Arvada, Colo.

[73] Assignee: Rocky Mountain Sheet Metal Company, Inc., Denver, Colo.

[21] Appl. No.: 376,253

[22] Filed: May 7, 1982

[51] Int. Cl.[3] ..... F24F 13/04

[52] U.S. Cl. ..... 98/38.1; 98/38.9

[58] Field of Search ..... 48/189.4; 98/38 R, 38 A, 98/38 B, 38 D, 38 E, 38 F, 40 V, 121 R; 236/13; 239/463, 472, 590.5; 366/338

[56] References Cited

U.S. PATENT DOCUMENTS

| | | | |
|---|---|---|---|
| 1,113,041 | 10/1914 | Murphy | 48/189.4 |
| 2,650,535 | 9/1953 | Hord | 98/94 |
| 2,684,024 | 7/1954 | Kurth et al. | 98/40 |
| 2,872,859 | 2/1959 | Kennedy | 98/38 |
| 2,884,846 | 5/1959 | Goudman et al. | 98/38 A |
| 3,180,245 | 4/1965 | Erickson, Jr. et al. | 98/38 |
| 3,212,424 | 10/1965 | Davis | 98/38 |
| 3,732,799 | 5/1973 | Spoormaker | 98/38 |
| 3,973,590 | 8/1976 | Logsdon | 137/601 |

*Primary Examiner*—Harold Joyce
*Attorney, Agent, or Firm*—John E. Reilly

[57] ABSTRACT

A fixed blade air mixing apparatus is characterized in particular by having a plurality of radially extending vanes which extend away from a common center and terminate at their outer ends in a generally polygonal shaped enclosure. The apparatus is principally intended for use in eliminating stratification of airstreams of different temperature flowing through a common passage, for example, in a heating, air conditioning or other ventilating duct, and the vanes are so constructed and arranged as to establish a predetermined discharge angle of the airstreams passing therethrough which when combined with a predetermined lateral clearance between the vanes will establish optimum mixing effectiveness and uniform velocity profile of the air downstream of the mixing apparatus with a minimum pressure drop as the air flows through the apparatus.

16 Claims, 8 Drawing Figures

FIXED BLADE AIR BLENDER APPARATUS

This invention relates to heating, ventilating and air conditioning systems; and more particularly relates to a novel and improved air mixing apparatus for establishing uniform distribution and temperature of air passing through a space or conduit while maintaining a uniform velocity profile and minimum pressure drop.

BACKGROUND OF THE INVENTION

In ventilating and air conditioning systems for buildings, intimate mixing of airstreams which are introduced at different temperature levels through a common duct is essential in order to avoid undesirable stratification of the air, for example, as a preliminary to its passage into a room air space. This problem is prevalent in intermixing cold outside air with warmer return air from a space, since the respective airstreams will tend to stratify or remain in separate layers and, when introduced into one or more areas or spaces, will exhibit a wide disparity in temperature. Various types of movable damper or mixing valve systems have been devised in the past to minimize or eliminate stratification of the air. Representative of such approaches are those dislcosed in U.S. Pat. Nos. 2,650,535 to P. E. Hord; 2,684,024 to F. J. Kurth et al; 2,872,859 to W. W. Kennedy; 3,212,424 to J. R. Davis; 3,732,799 to H. J. Spoormaker; and 3,973,590 to H. G. Logsdon.

It is desirable to devise a mixing system or apparatus which is capable of intermixing airstreams of different temperature passing through a common duct so as to greatly improve mixing effectiveness and eliminate stratification of the air. U.S. Pat. No. 3,180,245 to Theodore Erickson et al discloses a mixing device in which a plurality of fixed blades or vanes radiate outwardly from a common center and are arranged in adjacent rings with the vanes in each ring pitched in an opposite direction to that of the other ring so as to develop a plurality of oppositely rotating, whirling streams. Although Erickson et al has been found to be effective in reducing stratification and increasing mixing effectiveness of airstreams which would otherwise tend to stratify, it has been found that vastly improved mixing effectiveness can be achieved through the utilization of one or more concentric rows of fixed blades or vanes within a single ring or frame by virtue of a novel and improved blade configuration and arrangement which will establish minimum pressure drop, maximize effectiveness in mixing the airstreams and maintain a uniform or flat velocity profile of the resultant mixed airstreams downstream of the mixing device.

SUMMARY OF THE INVENTION

It is therefore an object of the present invention to provide for a novel and improved air mixing device which will minimize to the extent of substantially eliminating stratification of airstreams.

It is another object of the present invention to provide for a novel and improved mixing apparatus which will maximize the mixing effectiveness of airstreams of different temperatures while maintaining a uniform velocity profile downstream of the mixing apparatus with a minimum pressure drop of the air passing through the apparatus.

A further object of the present invention is to establish optimum blade angles and spacing between fixed blades of a mixing device so as to achieve complete blending of airstreams irrespective of the intake arrangement of outside and return air.

It is a still further object of the present invention to provide an air blender which has no moving parts, is conformable for different sized openings and operative under a wide range in air velocities to achieve highly efficient mixing of airstreams of different temperatures so as to eliminate stratification of the airstreams; and further wherein the air blender apparatus of the present invention is conformable for use in new or existing installations to more efficiently intermix airstreams of differing temperatures.

In accordance with the present invention, an air mixing apparatus has been devised which is adapted for intermixing airstreams of different temperatures flowing through a duct in which the apparatus comprises an outer enclosure traversing the duct or passage, a central hub, and a plurality of radially extending vanes diverging away from said hub and terminating at their outer distal ends in said outer enclosure. Each vane curves rearwardly in a direction away from its leading edge and terminates in a trailing edge in parallel relation to the leading edge along its greater length; however, at the inner convergent end adjacent to the hub, each vane is inclined away from the original plane of the trailing edge to extend forwardly toward the leading end and define a clip angle therebetween which will establish a predetermined lateral clearance or relief area between the inner convergent end of each vane and the leading end of the next adjacent vane in the direction of flow of air therethrough. In addition, a pressure angle is established in each vane to control the direction of air flow past or through the mixing apparatus which will minimize the pressure drop while establishing maximum mixing effectiveness of the air.

In the preferred form, preferably the outer enclosure or housing in surrounding relation to the blades is of non-circular or polygonal configuration so that the outer extremities of the blades terminate in flat wall surfaces on the housing thereby greatly simplifying the construction and design of the blade for different sized mixing apparatus. This is a particular advantage for larger sized mixing apparatus in which an outer concentric arrangement of vanes can be added in surrounding relation to an inner concentric series of vanes. In this relation, utilization of inner and outer concentric rows of vanes permits standardization of one basic size of mixing apparatus which for larger passages can be expanded by the addition of a separate row or series of vanes in outer concentric relation to the basic mixing apparatus.

The above and other objects, advantages and features of the present invention will become more readily understood and appreciated from a consideration of the following detailed description of a preferred embodiment of the present invention when taken together with the accompanying drawings in which:

DETAILED DESCRIPTION OF THE PREFERRED EMBODIMENT

Figure 1:
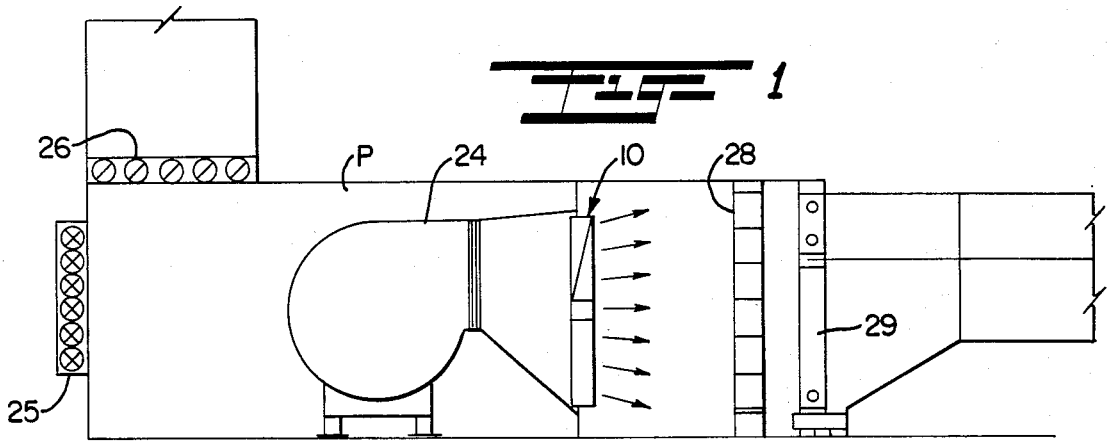
FIG. 1 is a somewhat schematic view illustrating the disposition of the preferred form of mixing apparatus in a dual duct air conditioning system.

There is illustrated in FIGS. 1 to 4 of the present invention a preferred form of fixed blade air mixing apparatus 10 which is broadly comprised of an outer housing or enclosure 12, mounting plate 14, a central hub 16 and a series of fixed vanes or blades 18 which radiate outwardly from the central hub 16 and terminate in the outer enclosure 12. In the preferred embodiment, a series of outer concentric vanes 20 are illustrated and which extend in predetermined spaced relation to one another between the outer enclosure 12 and a second outer concentric enclosure 22 which is surrounded by the mounting plate 14. The preferred form of arrangement is intended principally for larger sized openings or passageways. However, as illustrated in FIG. 1, the inner concentric series of blades 18 with outer housing or enclosure 12 may be used without the outer concentric blades or vanes 20 in controlling air mixing and distribution for smaller sized ducts.

As a setting for the present invention, FIG. 1 illustrates utilization of the air mixing apparatus 10 in an air conditioning system wherein the mixing apparatus 10 consisting only of the inner blade unit 18 is positioned on the outlet side of a fan or blower 24 which is disposed in a common passageway P. Outside air is directed through a damper control represented at 25 and return air drawn through a damper control represented at 26 and is discharged by the fan 24 through the air mixer 10 as a preliminary to passage through a filter zone 28 and coils 29 of a dual duct system. In such an arrangement, it is important that the outside air and return air which are being drawn at different temperatures through the common passageway P be intimately mixed so as to eliminate any tendency of the air to stratify into layers of different temperature as a preliminary to passage through the filter and coil section or, for that matter, directly into a room air space. Otherwise, there is a tendency for the coils 29 to freeze by virtue of the uneven temperature of the air if permitted to remain in layers.

In order to achieve maximum mixing effectiveness, the fixed blades 18 will cause a change in direction of the air so as to effectively swirl or rotate the air without creating undue turbulence. In particular, it is important that there be a minimum pressure drop as the air passes through the mixing apparatus and that the resultant air mixture downstream of the mixing apparatus retain a substantially uniform velocity profile across the area of the passageway P.

Figure 7:
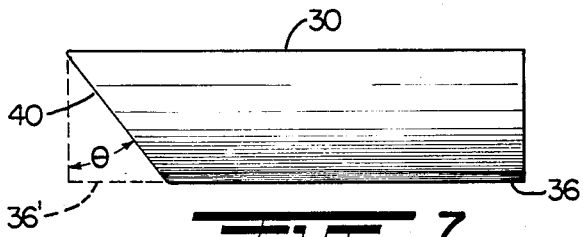
FIG. 7 illustrates the clip angle of a single blade in accordance with the present invention.
Figure 5:
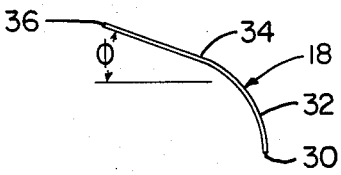
FIG. 5 illustrates the pressure angle of a single blade in accordance with the present invention.

To accomplish the foregoing, each blade 18 is defined by a leading edge 30 extending normal or perpendicular to the air flow with a straight portion 32 extending rearwardly in the direction of air flow away from the leading edge and continuing into a concave, laterally curved portion 34. The portion 34 extends at an acute angle to the direction of air flow into the apparatus and preferably is formed about a predetermined radius of curvature into a straight trailing edge portion 36 which is disposed along its greater length in rearwardly spaced parallel relation to the leading edge 30. Normally, the spacing between the vanes combined with the vane width between leading and trailing edge portions is such that the inner trailing edge portion 36 of each vane 18 adjacent to the hub would overlap the leading edge 30 of each next vane in succession in establishing the desired width and degree of lateral curvature or pitch of each vane in causing the air to change its direction of flow through the mixing apparatus. It has been determined, however, that overlapping of the blades as indicated by the dotted line 36' in FIG. 7 tends to cause a substantial drop in pressure at least in the central portion of the mixing apparatus together with a substantial increase in velocity downstream of the apparatus which would interfere with the maximum mixing effectiveness of the unit. In order to overcome this problem while maintaining maximum mixing effectiveness, each blade is formed with a clip angle $\theta$ or relieved area at its inner edge, the clip angle being formed by a forwardly inclined portion or edge 40 extending from the trailing edge toward the inner terminal extremity of the leading edge 30 at its intersection with the central hub. Specifically the clip angle $\theta$ is illustrated in FIG. 7 and is that angle formed between the axis through the hub and the inclined edge 40. In turn, the discharge angle $\phi$ or pitch of each blade, as illustrated in FIG. 5, will determine the direction of air flow leaving the blades. The angle $\phi$ is measured between a line through the trailing edge 36 of the blade and a line taken normal to the longitudinal axis of the hub 16, or direction of air flow. Thus, as the angle $\phi$ decreases, the degree of curvature or pitch of the blade effectively increases. Generally, a determination both of the clip angle $\theta$ and discharge angle $\phi$ is important in establishing proper blade design for a given sized opening or passageway in achieving maximum effectiveness in mixing air streams of different temperatures accompanied by a minimum pressure drop and uniform velocity.

In the construction of the apparatus, the inner and outer enclosures 12 and 22, respectively, preferably are of polygonal configuration, each made up of straight, rectangular wall sections or panels of equal length and arranged in end-to-end relation. In this way, the outer distal ends 42 of the vanes 18 may be squared for connection to the panels as illustrated. Similarly, both inner and outer ends 44 and 46, respectively, of the outer vanes 20 are squared for attachment to the straight panels which make up the inner and outer enclosures 12 and 22. The central hub 16 is defined by a slender support element, such as, an elongated rod so that the inner tapered ends of the vanes 18 will converge and effectively meet at the center support in adjoining relation to one another whereby the greatest possible open or visible area is provided across the entire cross-section of the mixing apparatus 10. For reasons to be more fully understood in connection with the description of the clip angles formed, this will afford more uniform mixing of the air while maintaining the flattest possible velocity profile of the air downstream of the mixing apparatus.

Figure 6:
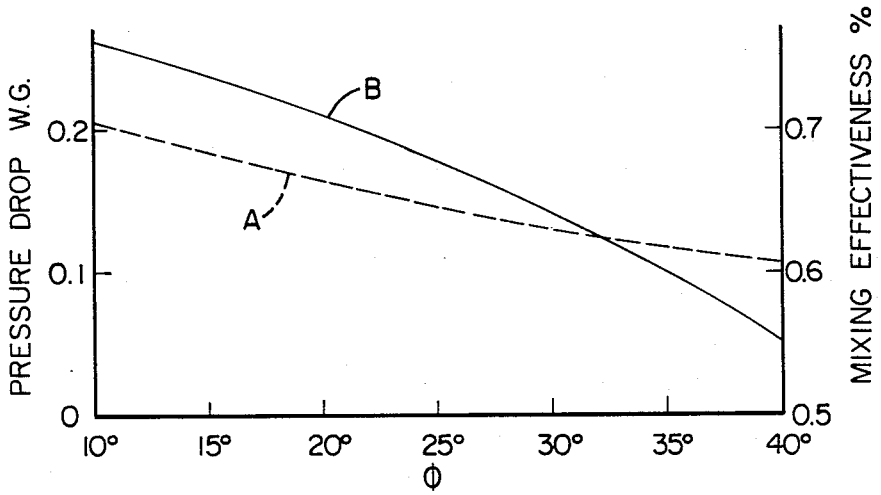
FIG. 6 is a graph illustrating variations in pressure and velocity for different given pressure angles.

For the purpose of illustration and not limitation, FIG. 6 is based on tests conducted of a mixing apparatus dimensioned for a 16" diameter opening or duct and is a plot of mixing effectiveness vs. pressure drop for different discharge angles $\phi$. Both the pressure and mixing effectiveness can be plotted at a selected point downstream of the mixing apparatus by measurements taken at a series of separate points throughout the cross-sectional area of the duct. For instance, assuming that the inlet cold air temperature is on the order of 70° F.–75° F., and the return or hot air temperature on the order of 115° F.–120° F. with 50% by volume of air at each temperature directed through the duct, 100% mixing effectiveness would be achieved if a plot of temperatures downstream of the mixing apparatus revealed the same temperature across the entire cross-section of the duct. Mixing effectiveness is therefore a function of the range or variation in temperatures measured across the area of the duct a predetermined distance downstream of the mixing apparatus. Specifically, in FIG. 6, the plot is based on air passing through the mixing apparatus at a velocity of 1500 fpm with a 0.2" pressure drop. FIG. 6 shows a reduction in pressure (line A) for a progressive reduction in curvature or increase in the angle $\phi$ from 10° to 40° where, as shown in FIG. 5, the angle $\phi$ is measured from a line taken perpendicular to the direction of air flow through each vane. From FIG. 6, it will be noted that the temperature mixing effectiveness (line B) undergoes a sharper reduction as the angle $\phi$ increases above 25° while the pressure drop is not affected as greatly as the angle $\phi$ is increased above 25°. Thus, optimum mixing effectiveness can be attained for a minimum reduction in pressure at an angle approximating 25° which corresponds to an angle of 65° to the direction of air flow. In other words, the angle $\phi$ as illustrated in FIG. 6 for a range of 10° to 40° would translate into a range of 80° to 50° to the direction of air flow.

Figure 8:
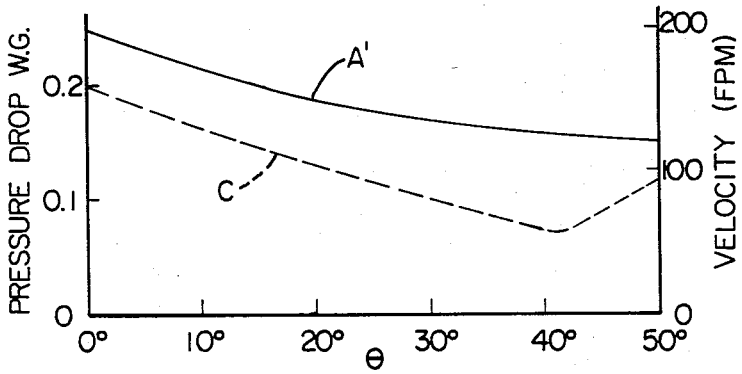
FIG. 8 is a graph illustrating the variation in pressure for different clip angles.
Figure 2:
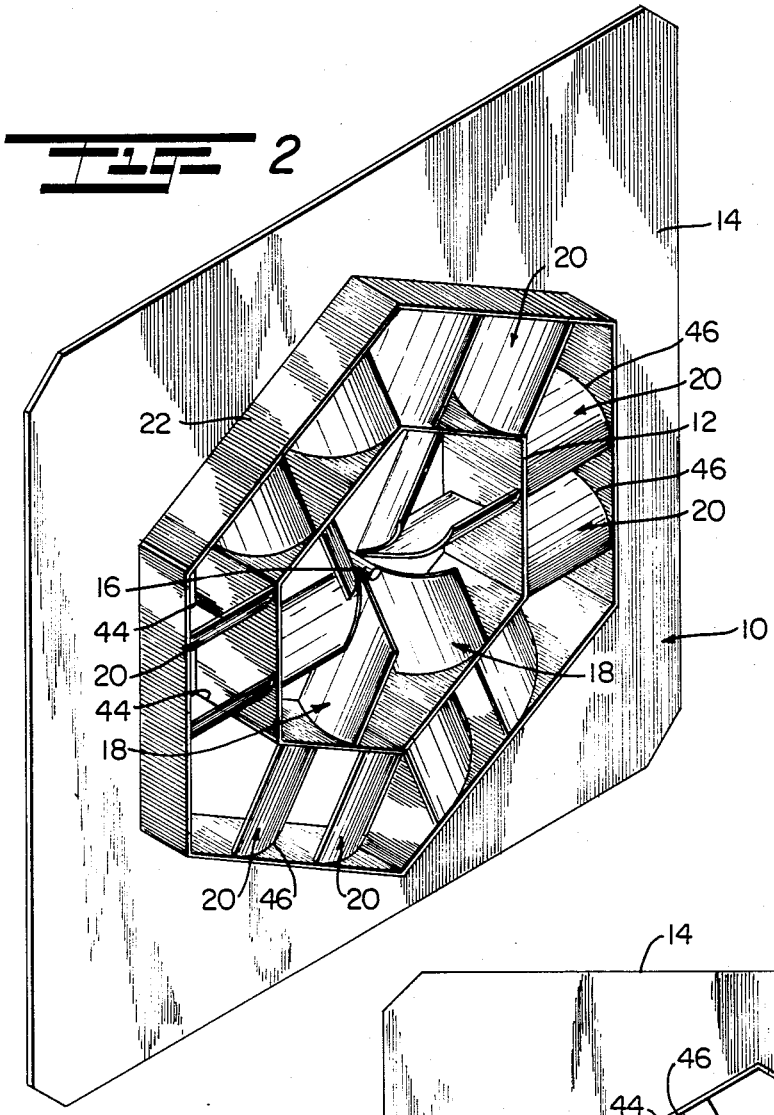
FIG. 2 is a somewhat perspective view of the preferred form of mixing apparatus of the present invention viewed from its rearward or downstream side.
Figure 4:
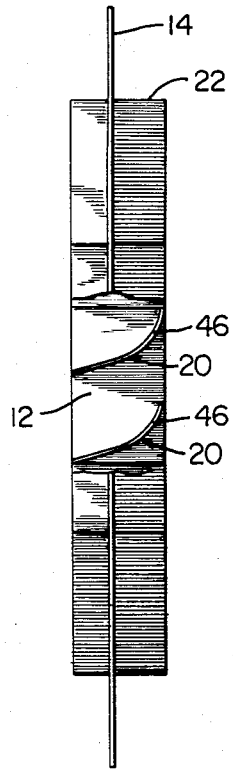
FIG. 4 is a side view with portions broken away of the preferred form.
Figure 3:
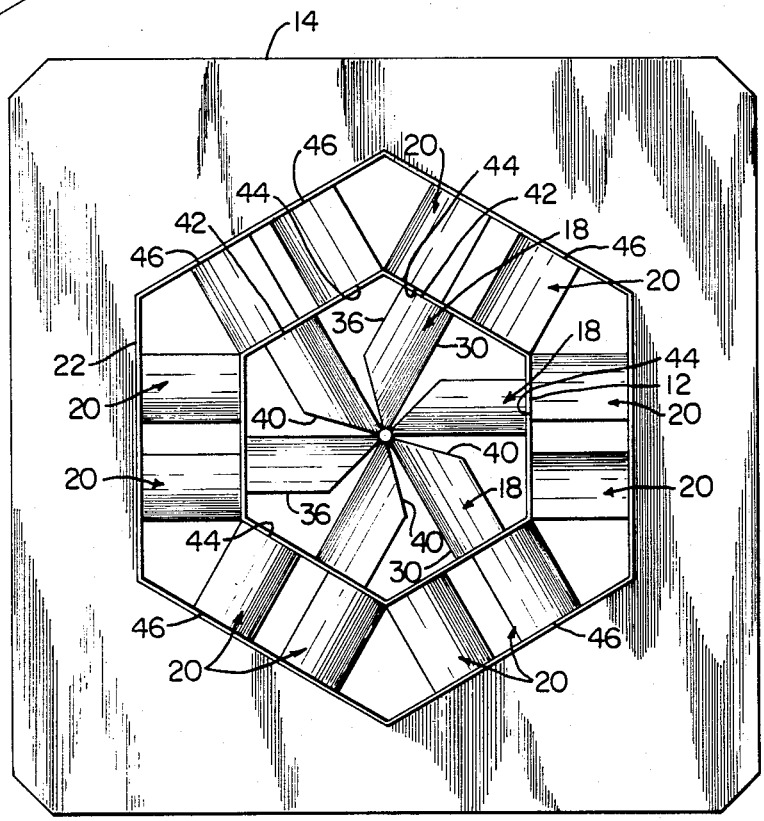
FIG. 3 is a rear view in elevation of the preferred form of mixing apparatus.

FIG. 8 illustrates a plot of pressure drop (line A') vs. velocity distribution (line C) at the same point downstream of the mixing apparatus as employed for measurement of the mixing effectiveness illustrated in FIG. 6. FIG. 8 reveals that for increasing clip angles $\theta$, which would result in greater visible free area to total area for passage of air through apparatus 10, as the clip angle is increased the variation or change in velocity was the lowest for an angle of 40° and that the pressure drop similarly was lower at this point. It is important to recognize that pressure drop as plotted indicates the amount of reduction in pressure compared to the pressure taken at the inlet side of the mixing apparatus and not the actual pressure level measured. The tests conducted and illustrated in the graphs of FIGS. 6 and 8 were based on a single series or row of inner concentric blades 18 for a 16" sized opening or duct. Additional testing conducted of larger sized ducts in which a second outer concentric row or series of vanes were added, for example, as illustrated in FIGS. 2 to 4, revealed that the same conditions or parameters hold true in selecting optimum discharge and clip angles.

It will be apparent that the size of the basic mixing apparatus may be varied for different sized passageways in establishing efficient mixing of the air. It is preferred, however, to establish basic sizes of the inner concentric blade arrangement as described; and for increasing sizes of ducts or passageways to add an outer concentric series of blades 22. The determination of different basic sizes of the inner concentric blade arrangement will be governed to a great extent by the optimum free area versus face or total area required in meeting the criteria established in relation to optimum mixing effectiveness, pressure drop and velocity as discussed in relation to FIGS. 5 to 8. Different sized outer concentric blades 22 may then be made available in combination with the basic sizes for duct or passageway sizes that fall between the basic sizes selected.

In the preferred form, a pair of blades 20 are disposed between each inner and outer concentric pair of wall surfaces 13 and 21 of the inner and outer enclosures 12 and 20, respectively, and spaced to extend as uniformly as possible in outer concentric surrounding relation to the inner concentric blades 18. A simplified construction and arrangement of blades is made possible through the use of the outer polygonal enclosures 12 and 22 so that each blade may be squared at its ends and not require different specific curvatures for each different sized enclosure, which would be the case if circular enclosures were employed. In maintaining uniform spacing between each pair of blades throughout their length, mixing effectiveness of the basic structure is maintained while minimizing the pressure drop and maintaining a uniform velocity profile downstream of the mixer.

While the present invention has been described in its application to mixing of outside and return air, it is conformable for use in virtually any application for mixing air or gaseous streams and combinations of same. It is a fixed device with no moving parts which can be mounted in circular or rectangular air ducts or passageways of different configurations. It will substantially reduce costly hours of operation through the efficient use of outside air and is capable of operating efficiently over a wide range in air velocity; nor is its efficiency impaired by clogged filters.

It is therefore to be understood that while a preferred form of invention has been set forth and described, various modifications and changes will become apparent to those skilled in the art without departing from the spirit and scope of the present invention as defined by the appended claims.

I claim:

1. Air mixing apparatus adapted for intermixing airstreams of different temperatures flowing through a common passage, comprising:

an outer enclosure traversing said passageway;

a central hub; and a plurality of radially extending vanes diverging away from said hub and terminating at their outer distal ends adjacent to said outer enclosure, each of said vanes including a straight leading edge portion across its length extending rearwardly in the direction of air flow and curving laterally into a straight trailing edge at a uniform acute angle along its length to the direction of air flow through said flow passageway, and an inner convergent end on each vane tapering forwardly and inwardly from said trailing edge to said leading edge and terminating at said central hub, each said convergent end defining a lateral clearance space between said inner convergent end of each vane and said leading edge portion of each next adjacent vane.

2. Apparatus according to claim 1, said inner convergent end defining a clip angle which is disposed at an angle on the order of 40° to the central axis of said hub.

3. Apparatus according to claim 1, each of said vanes pitched in a common direction at a uniform discharge angle in the range of 50° to 80° to the direction of flow through said passageway.

4. Apparatus according to claim 1, said central hub being in the form of a slender support member dimensioned such that said vanes converge together in adjoining relation to one another.

5. Apparatus according to claim 1, said outer enclosure having flat wall surfaces in facing relation to said outer distal ends of said vanes, said outer distal ends of said vanes being squared to their length for connection to said flat surface portions.

6. Apparatus according to claim 5, said outer enclosure being polygonal so as to be defined by a plurality of circumferentially extending flat wall surface portions arranged in end-to-end relation to one another.

7. Apparatus according to claim 3, including a second series of vanes arranged in outer concentric relation to said outer enclosure, said second series of vanes extending in radial spaced relation to one another about the outer periphery of said outer enclosure.

8. Apparatus according to claim 7, said outer concentric vanes arranged in substantially uniformly spaced relation to one another and having discharge angles corresponding to the discharge angles of said inner vanes, and a second outer enclosure in outer surrounding relation to said second series of vanes.

9. Apparatus according to claim 8, said first outer enclosure and said second outer enclosure being of polygonal construction having flat wall surface portions extending in end-to-end relation about said outer distal ends of said respective vanes.

10. Air mixing apparatus adapted for intermixing air streams of different temperatures flowing through a common passage comprising:

an outer enclosure of generally polygonal configuration traversing said passage;

a plurality of radially extending vanes diverging away from a common center and terminating at their outer distal ends in said outer enclosure, each vane curving rearwardly in a direction away from its leading radial edge to terminate in a trailing edge in spaced parallel relation to said leading edge, said inner convergent end on each vane tapering forwardly and inwardly from said trailing edge to said leading edge and terminating at said common center, said convergent end defining a lateral clearance space between said inner convergent end of one vane and said leading edge portion of each next adjacent vane; and a series of vanes arranged in outer concentric relation to said outer enclosure, said vanes extending in radial spaced relation to one another about the outer periphery of said outer enclosure, said outer concentric vanes arranged in substantially uniformly spaced relation to one another, and a second outer enclosure in outer surrounding relation to said outer concentric vanes, said first outer enclosure and said second outer enclosure being of polygonal construction having thin flat wall surface portions extending in end-to-end relation to one another about said outer distal ends of said respective inner and outer vanes in a direction parallel to the flow of air through said apparatus.

11. Air mixing apparatus according to claim 10, said outer concentric series of vanes being pitched in the opposite direction to said inner radially extending vanes.

12. In an air conditioning system wherein return air is to be intermixed with outside air and a blower is provided to draw said return air and outside air through a common passageway, the combination therewith comprising:

air mixing apparatus traversing said passageway downstream of said blower including an outer generally polygonal enclosure disposed transversely across said passageway, a central hub, and a plurality of radially extending vanes disposed in radially extending, substantially equally spaced circumferential relation about said central hub for outward radial extension to terminate at their outer distal ends in said enclosure, each vane curving across its width from a straight leading radial edge in facing relation to said blower into a spaced parallel trailing edge downstream of said leading edge, an inner convergent end on each vane conforming to the contour of said vane and tapering forwardly and inwardly from said trailing edge to said leading edge and terminating at said central hub, said inner convergent ends each forming a divergent clip angle defining an open clearance space between adjacent vanes sufficient to establish a uniform velocity of air with a minimum pressure drop flowing through said mixing apparatus from said blower.

13. In an air conditioning system according to claim 12, each trailing edge on a vane tapering at its inner convergent end into said leading edge to define said clearance space.

14. In an air conditioning system according to claim 13, each of said vanes being curved in a common direction at an angle on the order of 65° to the longitudinal axis of said passageway and the direction of air flow therethrough.

15. In an air conditioning system according to claim 14, said vanes characterized by having a series of inner and outer concentric vanes extending in a radial direction, said inner and outer concentric vanes separated by a generally polygonal enclosure in surrounding relation to said inner concentric vanes, and said outer polygonal enclosure arranged in outer surrounding relation to said outer concentric series of vanes.

16. In an air conditioning system according to claim 15, said outer enclosure having vane pairs in spaced relation to one another between inner and outer flat surface portions of said intermediate and outer enclosures.

* * * * *